US006575828B1

(12) United States Patent
NewDelman

(10) Patent No.: US 6,575,828 B1
(45) Date of Patent: Jun. 10, 2003

(54) GAME USING GAME AND OUTCOME INDICIA

(76) Inventor: Mitchell J. NewDelman, Apt. 505, 1065 E. Flamingo Rd., Las Vegas, NV (US) 89119

( * ) Notice: Subject to any disclaimer, the term of this patent is extended or adjusted under 35 U.S.C. 154(b) by 0 days.

(21) Appl. No.: 09/599,162

(22) Filed: Jun. 21, 2000

(51) Int. Cl.[7] ..... A63F 13/00

(52) U.S. Cl. ..... 463/16; 273/138.1; 273/293; 273/296; 273/304

(58) Field of Search ..... 273/269–270, 273/274, 138.1, 139, 144 R, 292–293, 296, 303–304, 307–308, 459–461; 463/9–13, 16–17, 22, 25, 43, 46–47

(56) References Cited

U.S. PATENT DOCUMENTS 4,462,597 A * 7/1984 Caramazza ..... 273/296
5,277,424 A * 1/1994 Wilms ..... 273/85 CP
5,324,041 A * 6/1994 Boylan et al. ..... 273/292
5,630,753 A * 5/1997 Fuchs ..... 463/9
5,813,673 A * 9/1998 Richardson ..... 273/292
5,947,822 A * 9/1999 Weiss ..... 463/13
5,951,397 A * 9/1999 Dickinson ..... 463/36
5,967,517 A * 10/1999 Villano ..... 273/292
5,984,310 A * 11/1999 English ..... 273/292
6,027,119 A * 2/2000 De Lisle ..... 273/292
6,070,875 A * 6/2000 Boylan et al. ..... 273/292
6,098,984 A * 8/2000 Moore, Jr. ..... 273/292
6,102,403 A * 8/2000 Kaufman ..... 273/292
6,110,040 A * 8/2000 Sanduski et al. ..... 463/13
6,149,157 A * 11/2000 Suan ..... 273/292
6,165,069 A * 12/2000 Sines et al. ..... 463/12
6,170,827 B1 * 1/2001 Lombardo et al. ..... 273/292

* cited by examiner

*Primary Examiner*—Valencia Martin-Wallace
*Assistant Examiner*—Scott E. Jones
(74) *Attorney, Agent, or Firm*—Philip J. Anderson; Anderson & Morishita, LLC

(57) ABSTRACT

A device and method for playing a card game where four game cards are selected. To win, a fifth, outcome card must have either a higher or lower value than any same suited game card.

12 Claims, 1 Drawing Sheet

GAME USING GAME AND OUTCOME INDICIA

FIELD OF THE INVENTION

The present invention relates to casino and lottery games using real or computer generated playing cards or other real or computer generated indicia including a value and at least one other characteristic.

BACKGROUND OF THE INVENTION

Card games such as Poker and the like are widely popular. Recently, with the advent of micro processors, games such as video Poker have become very popular as casino games. As is known, in video Poker an electronic device is provided which includes a processor to control the action of the game. The player makes a wager and prompts play whereupon the processor, using a random number generator (RNG), selects and displays at a video display an initial, five card hand. The player, using buttons or a touch screen, selects the cards to hold, or conversely discard, and for any discards replacements are randomly selected to define a five card, final outcome hand. Based upon the final hand and established pay table for the game, the player either wins or loses.

In regards to electronic gaming machines, it is also known to provide for the play of Blackjack.

A drawback to video Poker and video Blackjack is that some novice players shy away from the games since they do not either understand the game or do not know a winning strategy to be applied. Further, for inexperienced players, play may be slowed as they try to discern how to play a hand. For casinos, slow play typically results in reduced earnings.

There is a need for a new game which is easy to understand, which can provide the player the stimulation provided by play strategy and which provides for fast play.

It has also been known to provide scratch-off tickets or video lottery games of chance. For scratch-off tickets, a player purchases a ticket having one or more scratch-off windows. By scratching off one or more windows the player determines whether they have won a prize. For video lottery games, the same technique is used. The basic difference between a lottery game and a casino game is that in a lottery game, the player has no options to exercise choice and the outcome and award is strictly dictated by randomness and chance whereas a casino game may include elements of choice and skill.

There is a need to incorporate into a lottery game, a game which is fun and simple to play. There is a need for a game which can be played in a casino setting where a player can make choices or selections as well as a lottery game where no such choice or selection may be provided.

SUMMARY OF THE INVENTION

There is, therefore, set forth according to the present invention a game method for playing a game which provides for a player to make a wager to play the game. In the casino game version, which may be played using an electronic device or as a table game, after the wager has been made, at least two and preferably four game cards (player cards) are dealt from a deck of cards, each card having its value and a suit as is well known in the art. An outcome card (house card) is dealt from the deck and its suit and value compared to the suits and value of each game card. For the player to win their wager, the outcome card must be of the same suit as at least one of the game cards and have a lesser value in that same suit. If the player wins they are paid even money. If the outcome card has a higher value of any same suited game cards or is of a different suit than any of the game cards, the player loses their wager.

In an alternative embodiment, for the player to win their wager, the outcome card must have a higher valuer than any same suited game card.

In still another embodiment, for the player to win, the outcome card must be of a suit different from that of any game card.

In still a further embodiment the player may be given the option of increasing their wager prior to selection of the outcome card.

In still another embodiment, cards or other indicia could be used which have value and another characteristic (e.g. color or design) different from suit and value of traditional playing cards such as sets cards having numbers and of different colors.

The foregoing embodiments could be embraced in a lottery game where windows representing the game and outcome cards or indicia. The player would scratch or reveal the outcome card or outcome and game cards as well as a prize.

In yet another embodiment for a casino game, the player, prior to the selection and display of the outcome card, may exercise the option of discarding and replacing one or more game cards in an effort to obtain a set of game cards likely to result in the player winning their wager.

Also set forth is an electronic device for playing the casino or lottery game of the method.

The game and device of the present invention provides for fast and easy play, fun and excitement.

BRIEF DESCRIPTION OF THE DRAWINGS

These and other features and advantages will become appreciated as the same becomes better understood with reference to the description, claims and drawings wherein:

DESCRIPTION OF THE INVENTION

Figure 1:
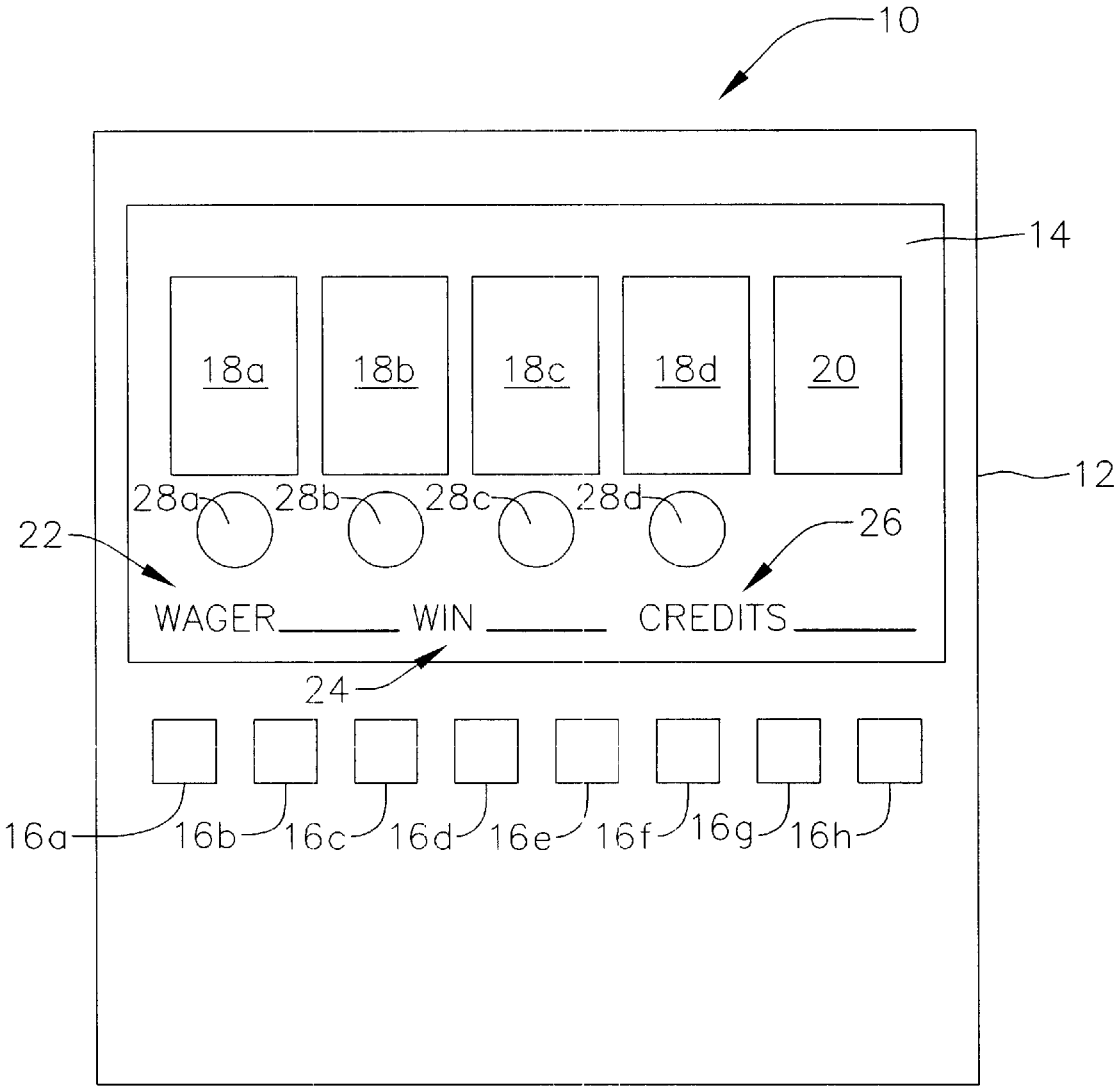
FIG. 1 shows a device and display for the play of the game.

Turning to FIG. 1 a device 10 is shown for playing the game according to the present invention. While the device 10 is shown, it is to be understood that the game could be played as live table game or as a lottery game using an electronic device or scratch-off lottery tickets. The device 10 has a closed housing 12 which contains, as is known in the art, a computer processor to control play in the manner described below and a hopper for receiving and dispensing coins or tokens used in the play of the game. The housing 12 also mounts a video display 14 which may include a touch screen for the player to make selections as hereinafter set forth.

To control the play and operation of the device 10, the touch screen display 14 or buttons 16*a–h* may be used. Button 16*a*, if depressed will send a signal to the processor to control the hopper to dispense accumulated game credits to the player, the coins, as is well known, dispensed into a tray. Button 16*b* enables the player to wager accumulated credits in one credit increments to play the game. Buttons 16*c–f* are tied to each of four game cards 18*a–d* and are used to hold/discard any selected game card during play of the game in a manner similar to that of video Poker. Button 16*g* if depressed enables the player to wager for the play of a hand the maximum amount permitted by the device 10, e.g. 5 units. Finally button 16*h* is a deal/draw button to prompt play of the game.

The display 14 is controlled by the processor to display the game cards 18*a–d*, an outcome card 20, a wager meter 22 which displays and confirms the amount of the wager, a win meter 24 to display the amount won by the player and a credit meter 26 to display the current amount of credits available for wagering.

The display also, below each game card 18*a–d*, has a hold/discard indicator 28*a–d* which confirms which game card 18*a–d* is held/discarded.

While not shown, the device 10 also includes means for the player to make a wager and accumulate credits. These means, as is well known in the art, may include a coin slot and coin tester by which the player can insert coins or tokens as wagers. The inserted coins or tokens are routed to the hopper for storage thereof. Additionally or alternatively, the device 10 may include a cash validator to accept cash and accumulate a corresponding value of credits shown at the credit meter 26 for play. A card reader may also be provided by which the player using a debit or credit card can enter wagers for play.

To play the game, the player enters a wager to play a hand of the game. Where the player makes a maximum wager, play is automatically prompted. Where less than a maximum wager is made, the player depresses the deal draw button 16*h* to prompt play. Upon prompting of play, the processor from a data structure or memory storing data representing each card of a deck of cards including their suit and value, randomly arranges (shuffles) all the cards into a sequence defining the deck, selects cards in order from the arranged deck and controls the display 14 to display each selected game card 18*a–d*. As but an example, the processor may initially select and display game cards as below.

| Game Card | 18a | 18b | 18c | 18d |
|---|---|---|---|---|
| | Q♡ | 4♧ | 8♧ | 7◇ |

According to the preferred embodiment of the game, the player has the option of discarding and receiving replacement cards for two of the initially dealt game cards 18*a–d*. For example, the player may select, using the touch screen display 14 or button 16*d*, to discard the 4♧. The processor selects for any discarded cards the next cards in order from the arranged deck (depleted of data representing the initially dealt cards) a replacement card. Thus, if the replacement card 18*b* is a K♤ the game cards 18*a–d* are now as below.

| Game Card | 18a | 18b | 18c | 18d |
|---|---|---|---|---|
| | Q♡ | K♤ | 8♧ | 7◇ |

Upon replacement of any game cards 18*a–d*, the processor selects from the arranged deck (depleted of data representing the initially dealt game cards 18*a–d* and any replacements) the next card in order representing an outcome card 20 which is displayed at the display as shown in FIG. 1. The processor also compares the outcome card 20 to determine if the outcome card 20 has a lesser value than any suited game cards 18*a–d*. For example, if the outcome card selected and displayed is a 10♤ the player, according to this embodiment of the game, wins their wager since the value of the outcome card 20 is less than that of the suited ( Spade suit) game card 18*b* (K♤ The processor for a winning outcome issues a reward to the player, shows the reward issued at the win meter 24 and controls the hopper to dispense coins or token or increases the amount shown on the credit meter 26 by the amount of the win. For wins the player is paid even money.

To play another hand the player inputs a new wager and prompts play. The selection of the game cards 18*a–d* and outcome cards 20 from the arranged deck for play of sequential hands continues to deplete the arranged deck until there are insufficient cards left for play at which time the processor randomly arranges i.e. shuffles, the deck into a new sequential order. If desired, the device 10 may include at the touch screen display 14 or have a button where the player can control the processor to re-shuffle the deck before play of the next hand regardless of the number of cards left in the virtual deck.

In the preferred embodiment, the player only has the option to replace two game cards 18*a–b*.

Some examples of play further illustrate the method of the present invention.

EXAMPLE 1

| | | | | | |
|---|---|---|---|---|---|
| Initial Deal of Game Cards | 10♡ | A♧ | 2♧ | 10♤ | |
| Discard | | | 2♧ | 10♧ | |
| With Replacements | | 10♡ | A♧ | 5♧ | 5♡ |
| Outcome Card | 2◇ | | | | |

This hand is a loss to the player since there is no game card 18*a–d* having the same suit (Diamond) as the outcome card 20.

EXAMPLE 2

| | | | | |
|---|---|---|---|---|
| Initial Deal of Game Cards | 10◇ | Q♤ | J♤ | 5♧ |
| Discard | | | J♤ | 5♧ |
| With Replacements | 10◇ | Q♤ | 10♤ | 2◇ |
| Outcome Card | 9♤ | | | |

This hand is a win to the player since the outcome card 20 has a lower value than any matching suit card of the game cards 18*a–d*, e.g. the 9♤ is lower than the Q♤ or 10♤.

EXAMPLE 3

| | | | | |
|---|---|---|---|---|
| Initial Deal of Game Cards | K♤ | 10♤ | Q♡ | 10♡ |
| No Replacements | | | | |
| Outcome Card | 9♤ | | | |

This hand is a win to the player since the outcome card 20, in comparison to any game cards 18*a–d* of the same suit, has lower value.

The game may be played where, to obtain a reward, the outcome card 30 must have a greater value than same suited game cards 18*a–d*.

As can be appreciated the game according to the various embodiments of the present invention differs from games like video Poker since the player is playing to obtain one of a pre-selected schedule of hands. Further the game differs from games such as Baccarat and Blackjack since the player is not attempting to produce a hand value close to a pre-selected target value, i.e. nine for Baccarat and twenty-one for Blackjack. Each hand according to the present invention is unique and is not determined to be a winner based on some pre-selected schedule of winning outcomes or in relation to a pre-set target value.

The game can also be played in a Stud version where the player has no opportunity to discard and receive replacements and can be played where the player can only discard one game card 18*a–d* and receive a replacement therefor. Still further, the game according to the method may be played using more or fewer game cards 18*a–d* such as two, three or five. Still further, the game may provide a jackpot bonus if the game cards 18*a–d* alone or in combination with the outcome card 20 form any specific one of a plurality of card combinations such as Poker ranked hands or one of a pre-selected schedule of bonus hands such as suited Kings and Nines, e.g. K♡9♡K◊9◊ For example, if the game cards 18*a–d* represent four cards to a Straight and the outcome card 20 fills a five card straight and is the a winning hand, i.e. the outcome card 20, depending upon the version of the game being played, is the lowest or highest card of the Straight, the player may be entitled to a bonus because the outcome card (5th card) fills a winning combination through the normal play of the game.

In an alternative embodiment, the player may have the option of increasing their wager upon exposure of the game cards but prior to exposure of the outcome card.

In another embodiment, the player's hand instead of being represented by the game cards, may be represented by the outcome card and the house represented by the game cards. Thus, in this embodiment of the game, for the player to win all suited game cards must be lower than the outcome card or no game cards are of the same suit as the outcome card. In this embodiment the player may be given the option to replace one or more game cards with the objective of lowering the values of the game cards or eliminating one or more suits so as to improve the player's chances of winning.

Still further, it should be understood that more than one deck could be used and that indicia other than playing cards could be used instead of playing cards such as sets cards numbered 1–13, each set having a different color, e.g. red, green, blue and yellow. Thus each indicia card has an assigned value and set characteristic which may be color, design or the like.

Further the game could be played where the outcome card, for the player to win their wager, must match in suit, value or sequence with the game cards.

In the lottery version of the game, the player has no option to replace game cards. For example, the player would purchase a scratch-off card having four scratch-off windows for the game cards, one scratch-off window for the outcome card and one scratch-off window for the prize. The player would scratch-off the windows to determine if the card is a wining card and the prize. Thus the lottery version can be played as a stud version as described above.

Electronic lottery may also be played in the same manner.

While I have shown and described certain embodiments of the present invention, it is to be understood that it is subject to modification without departing from the spirit and scope of the appended claims.

I claim:

1. A method for playing a casino game comprising:

a player making a wager to play the game;

displaying at least two game cards selected from a deck of playing cards, each card having a value and a suit;

the player discarding and receiving a replacement for at least one game card to define a final set of game cards; and revealing an outcome card and comparing the outcome card to the final set of game cards, the player winning their wager if the outcome card has one of a preselected greater or a lesser value than any of the same suited game cards of the final set of game cards.

2. The method of claim 1 including displaying four game cards.

3. An electronic device for a player to play a casino game comprising:

a video display;

a processor including a data structure storing data corresponding to a game indicia, each indicia having a value and belonging to one of a plurality of sets each having a common characteristic other than value;

means for the player to enter a wager;

means for the player to prompt play of the game, said processor in response to prompting play selecting from the data structure and controlling the display to display at least two game indicia and an outcome indicia and comparing the value and set characteristic of the outcome indicia to each of the game indicia;

means for the player to select at least one of the game indicia for replacement, said processor programmed to select from the data structure and display a replacement game indicia for the game indicia selected for replacement; and means for rewarding the player based upon the wager if the outcome indicia is determined to be of one of a lesser or greater value than any game indicia having the same set characteristic.

4. The device of claim 3 comprising said processor programmed to select four game indicia.

5. The device of claim 3 comprising said data structure stores game and outcome indicia as playing cards, each card having a value and belonging to a suit.

6. An electronic device for a player to play a casino game comprising:

a video display;

a processor including a data structure storing data corresponding to a deck of playing cards;

means for the player to enter a wager;

means for the player to prompt play of the game, said processor in response to prompting play selecting from the data structure and controlling the display to display at least two game cards and an outcome card and comparing the value and suit of the outcome card to each of the game cards;

means for the player to select at least one of the game cards for replacement, said processor programmed to select from the data structure and display a replacement game card for the game card selected for replacement; and means for rewarding the player based upon the wager if the outcome card is determined to be of a greater value than any same suited game card.

7. The device of claim 6 including said processor programmed to select from the data structure said playing cards, means for the player to select a game card for replacement and prompt play, said processor in response to prompting of play selecting from the data structure and displaying at the display a replacement playing card for the card selected for replacement and to select from the data structure said outcome card.

8. The device of claim 6 including said processor programmed to select four game cards.

9. A method for playing a casino game using a deck of playing cards comprising:

a player making a wager to play the game;

dealing from a deck of playing cards, four game cards, each card having a value and a suit;

the player replacing from the deck of cards at least one game card;

dealing an outcome card and comparing the outcome card to each of the four game cards, the player winning their wager if the outcome card has a lesser value than any of the same suited game cards.

10. A method for playing a casino game using a deck of playing cards comprising:

a player making a wager to play the game;

dealing from a deck of playing cards, four game cards, each card having a value and a suit;

the player replacing from the deck of cards at least one game card;

dealing an outcome card and comparing the outcome card to each of the four game cards, the player winning their wager if the outcome card has a greater value than any of the same suited game cards.

11. A method for a player to play a game using a deck of cards comprising:

(i) the player making a wager to play a hand of the game;

(ii) dealing, from the deck of cards having said cards arranged by shuffling into an ordered deck, in sequential order form the deck, four cards defining an initial game hand;

(iii) the player discarding one or more cards of the initial game hand and being dealt, in order from the deck depleted of the cards of the initial game hand, replacements for any discarded cards to define a final game hand of four cards;

(iv) dealing, in order from the deck depleted of said initial and replacement cards, an outcome card;

(v) comparing the outcome card to each of the four game cards, the player winning their wager if the outcome card has one of a preselected lesser or greater value than any of the same suited game cards; and the player playing one or more successive games according to steps (i)–(v) with cards dealt in order from the deck, said player prompting re-shuffling an rearranging of the deck into a reshuffled order between any successive hands.

12. An electronic device for a player to play a casino game comprising:

a video display;

a processor including a data structure storing data corresponding to a deck of playing cards arranged in a random, ordered sequence;

means for the player to enter a wager;

means for the player to prompt play of the game, said processor in response to prompting play selecting from the data structure in ordered sequence and controlling the display to display at least two game cards and an outcome card and comparing the value and suit of the outcome card to each of the game cards;

means for the player to select at least one of the game cards for replacement, said processor programmed to select from the data structure in ordered sequence and display a replacement game card for the game card selected for replacement;

means for rewarding the player based upon the wager if the outcome card is determined to be of a greater value than any same suited game card; and means for the player to prompt reordering of the data sequence.

* * * * *